US005353457A

United States Patent [19]

Chu

[11] Patent Number: 5,353,457

[45] Date of Patent: Oct. 11, 1994

[54] PILLOW WITH A HEIGHT ADJUSTMENT DEVICE

[76] Inventor: Hsu M. Chu, No. 26, Lane 47, Hwai Tei Street, Taipei, Taiwan

[21] Appl. No.: 132,673

[22] Filed: Oct. 6, 1993

[51] Int. Cl.[5] ..... A47C 20/00

[52] U.S. Cl. ..... 5/640; 5/643

[58] Field of Search ..... 5/636, 640, 643, 934, 5/935, 937

[56] References Cited

U.S. PATENT DOCUMENTS

| | | | |
|---|---|---|---|
| 808,217 | 12/1905 | Reich | 5/643 X |
| 1,327,103 | 1/1920 | Knowles | 5/640 X |
| 2,668,964 | 2/1954 | Simmons | 5/640 X |
| 4,221,213 | 9/1980 | Gregory et al. | 5/640 X |
| 4,531,247 | 7/1985 | Eary, Sr. | 5/643 X |
| 5,033,138 | 6/1991 | Hong | 5/636 |

*Primary Examiner*—Michael F. Trettel

*Attorney, Agent, or Firm*—Lowe, Price, LeBlanc & Becker

[57] ABSTRACT

An pillow with a height adjustment device comprising a driving mechanism consisted of an axle, two driving gears spaced on the axle, and a knob coupled to the axle at one end, and two rack assemblies meshed with either driving gear and disposed beneath the cover cushion of the pillow, each rack assembly being consisted of a first rack and a second rack, slidably mounted in and extend through two guide tubes horizontally meshed with the respective driving gear at different height, the guide tubes being adapted to curve upwards at the outer portion of which so as to guide and support the first and second racks curved upwards at the portions near the end of the racks attached to the cover cushion to lift the cover cushion as the axle is turned by the knob in one direction; the first and second racks of each rack assembly will thus be moved downwards to lower the cover cushion as the axle is turned by the knob in the reversed direction.

4 Claims, 3 Drawing Sheets

PILLOW WITH A HEIGHT ADJUSTMENT DEVICE

FIELD OF THE INVENTION

The present invention relates to a pillow, and more particularly, to a pillow with a height adjustment device.

BACKGROUND OF THE INVENTION

People use pillows to ease their bodies while sleeping or resting. Nevertheless, people are usually accustomed to pillows of various thickness which meet their needs under different circumstances so more than one pillow is in personal use for most people, and as a result, more space is needed for placing and storing them. A pillow whose height is adjustable is thus desirable as all pillows conventionally used are of nonadjustable type.

SUMMARY OF THE INVENTION

The present invention has been accomplished under the aforesaid circumstances. It is therefore the principal object of the present invention to provide a pillow which can be conveniently adjusted to change its height as desired.

According to the present invention, a pillow with a height adjustment device comprising a base frame, a cover cushion supported on the base frame, a height adjustment device mounted on the bottom surface of the base frame for lifting the cover cushion is provided. The height adjustment device comprises two rack assemblies parallelly disposed at two opposite locations, and a driving mechanism adapted to operate the rack assemblies. Each one of the rack assemblies comprises a first rack, a second rack parallelly disposed below the first rack, locating frames bridged over the first and second racks, and guide tubes adapted to have the first and second racks slidably mounted therein and extended therethrough. The first and second racks are formed with teeth along the bottom of which and are attached to the bottom surface in an opposite position of the cover cushion with one end of each. Each one of the guide tubes is curved upwards at the outer portion near the end of the rack attached to the cover cushion in order to guide and support the racks extended therethrough to curve upwards in a reverse direction. The driving mechanism comprises an axle supported on spaced bearings, two spaced driving gears, adapted to be fit to the axle, respectively meshed between the first and second racks of either rack assembly, and a knob mounted on one end of the axle for turning the axle and the driving gears. In addition, said two guide tubes are respectively secured in the inner portion thereof to the locating frames. Turning the knob counterclockwise or clockwise, will cause the first and second racks to be either moved outwards and upwards in a reverse direction to lift up the cover cushion, or moved inwards and downwards toward each other to lower down the cover cushion. A lock member is secured to the base adjacent to the driving gear near the end of the axle without the knob for locking the driving mechanism. The lock member will be released from the driving mechanism as the knob is axially depressed.

According to the present invention, a reversible motor may be further mounted on the base of which a reversing switch is used to turn the axle and the driving gears, and an electromagnetic coil is electrically connected to the reversible motor to release the lock plate from the driving mechanism as the reversible motor is turned on.

DETAILED DESCRIPTION OF THE PREFERRED EMBODIMENT

Figure 1:
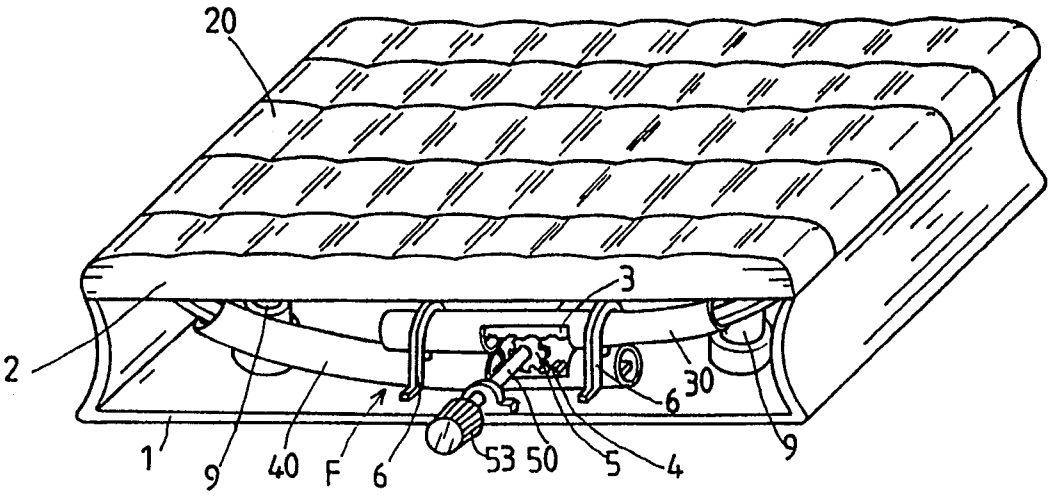
FIG. 1 is a perspective view of a height adjustable pillow according to the preferred embodiment of the present invention.
Figure 3:
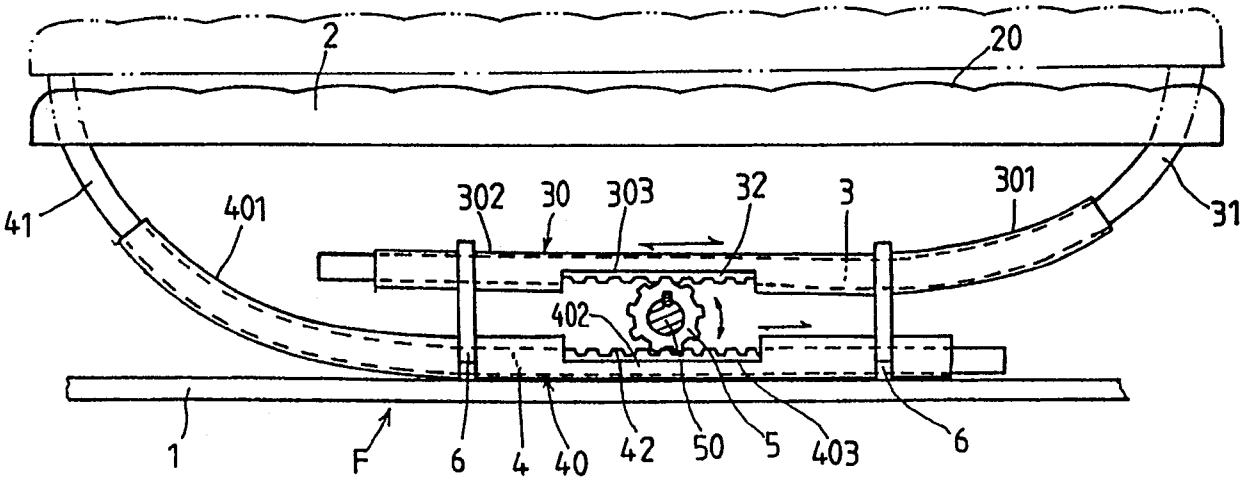
FIG. 3 is a front view of the elevation adjustment device of the height adjustable pillow, showing the driving gears turned clockwise to extend the first and second racks bilaterally outwards.
Figure 2:
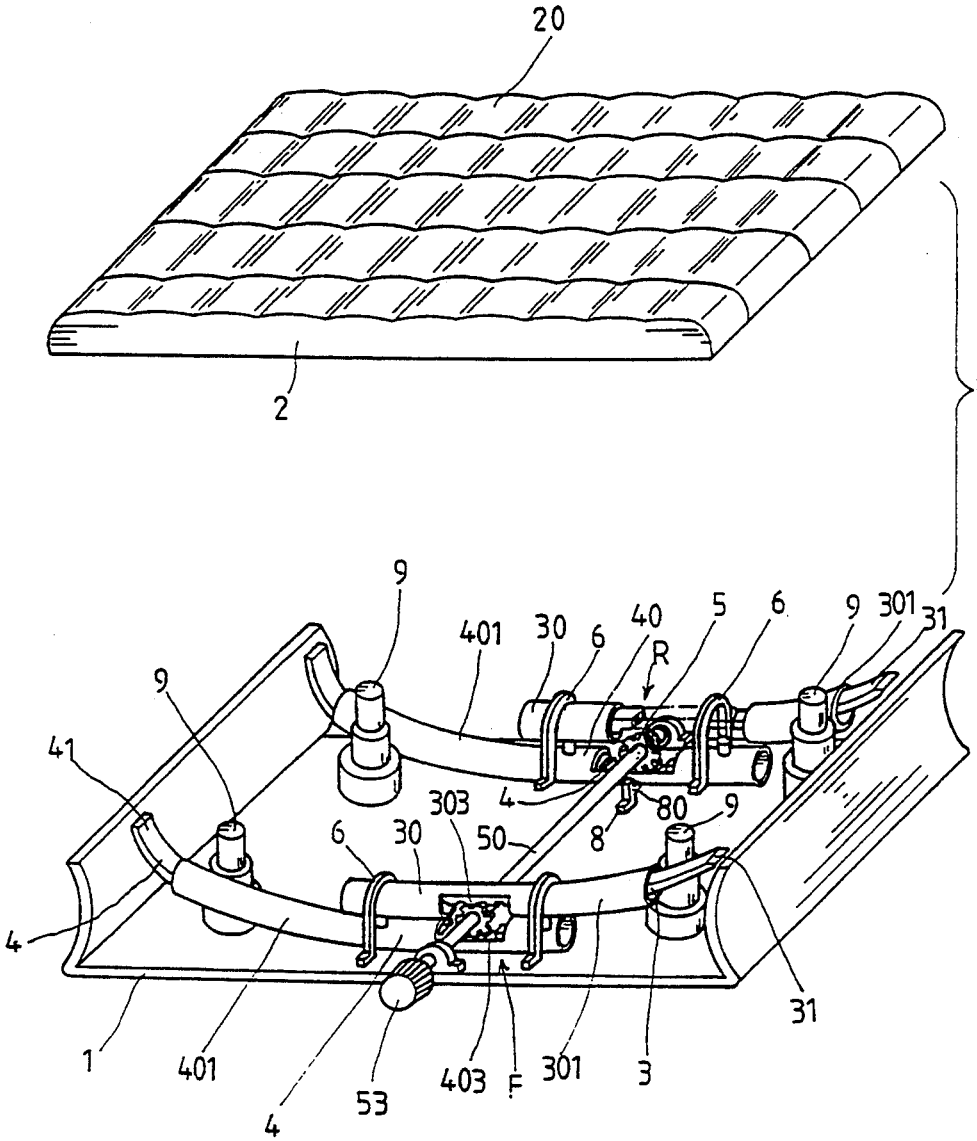
FIG. 2 illustrates the cover cushion of the pillow removed from the base thereof.

Referring to FIGS. 1, 2, 3 and 4, a height adjustable pillow in accordance with the present invention is generally comprised of a base 1, a cover cushion 2, and a height adjustment device. The cover cushion 2 is positioned at the top of the base 1, having a top pillow face 20 made of rattan skin, bamboo skin, cloth, . . . etc., for resting the head. The height adjustment device is consisted of two sets of mechanisms, namely, the mechanism R and the mechanism F.

The mechanism R or F comprises a first rack 3, and a second rack 4 parallelly disposed below the first rack 3. The first rack 3 is slidably mounted in and extended through a hard guide tube 30 which is curved upwards at its outer portion 301, and is attached to one side of the bottom surface of the base 1 (the right-hand-side one as shown in the figure) at its end 31. The inner portion 302 of the hard guide tube 30 has an opening 303 positioned beneath the middle part of the cover cushion 20 to expose a teeth portion 32 of the rack 3, which is a portion of the rack 3 formed with continuous teeth. The second rack 4 is also slidably mounted in and extended through a hard guide tube 40 which is curved upwards at its outer portion 401, and is attached to the bottom surface of the base 1 (the left-hand-side one as shown in the figure) at its end 41. The inner portion 402 of the hard guide tube 40 has an opening 403 positioned beneath the middle part of the cover cushion 20 to expose a teeth portion 42 of the rack 4 which is a portion of the rack 4 formed with continuous teeth.

A driving gear 5 is mounted between the opening 303 of hard guide tube 30 and the opening 403 of hard guide tube 40 to engage with the teeth portion 32 of the first rack 3 and the teeth portion 42 of the second rack 4. Two reversed U-shaped locating frames 6, 6 are bridged over the first and second racks 3, 4 and disposed at two opposite sides relative to the driving gear 5, or to the openings 303, 403, each consisted of two upright side walls 60, 60 with the bottom ends thereof secured to the base 1 such that the hard guide tubes 30, 40 are clamped in between the side walls 60, 60; in addition, two support pillars 61, 61 are disposed between the hard guide tubes 30, 40 to push the hard guide tube 30 upwards toward the cross top wall 62, 62 of the locating frames 6, 6 and the hard guide tube 40 downwards toward the base 1 whereby the hard guide tubes 30, 40 are prevented from moving up and down and the teeth portions 32, 42 of the racks 3, 4 exposed from the openings 303, 403 of the hard guide tubes 30, 40 are securely engaged with the driving gear 5. Therefore, by turning the driving gear 5, teeth portions 32, 42 will be longitudinally slided.

The driving gears 5, 5 of the two mechanisms F, R are respectively mounted on an axle 50. The axle 50 is supported on two opposite bearings 51, 52 on the base 1, having one end (the front end) extended out of the base 1 and coupled with a rotary knob 53. A compressible spring 7 is mounted around the rear end of the axle 50 and retained between the driving gear 5 of the mechanism R and the adjacent bearing 52. A stop element 8 with a locking projection 80 stemmed out of the top portion of which is disposed on the base 1 in front of the driving gear 5 of the mechanism R. The driving gear 5 of the mechanism R is pushed forward toward the stop element 8 by the compressible spring 7, causing the locking projection 80 to engage into the teeth of the driving gear 5 of the mechanism R, and therefore the mechanisms R, F are locked.

Further, there are upright extensible support pillars 9, 9, 9, 9 disposed between and secured to the four corners of the base 1 and the cover cushion 2 to prevent the position of the cover cushion 2 from imbalance as the mechanisms R, F are put to work.

Adjusting the height or the cover cushion 2 is to be achieved by pushing the knob 53 inwards to move the driving gears 5, 5 of the mechanism R away from the locking projection 80 of the stop element 8 (see FIG. 4), so as to turn the knob 53. As the knob 53 is turned clockwise, as shown by the arrow in FIG. 3, the driving gears 5, 5 and the axle 50 will be turned clockwise whereby the teeth portions 32, 42 of the first and second racks 3, 4 meshed with the driving gears 5, 5 will be concurrently moved to the right and left of the figures to lift up the cover cushion 2 by the two racks 3, 4 which are curved upwards by way of the curved outer portions 301, 401 of the hard guide tubes 30, 40. As the knob 53 is turned counterclockwise, the driving gears 5, 5 and the axle 50 are turned counterclockwise as well, whereby the racks 3, 4 will be respectively moved downwards by way of the curved outer portions 301, 401 of the hard guide tubes 30, 40 to lower the cover cushion 2 (see the lines shown in FIG. 3).

Therefore, the height adjustment of the cover cushion 2 of the pillow is to be carried out by pushing the knob 53 inwards and then turning it in either direction.

Figure 5:
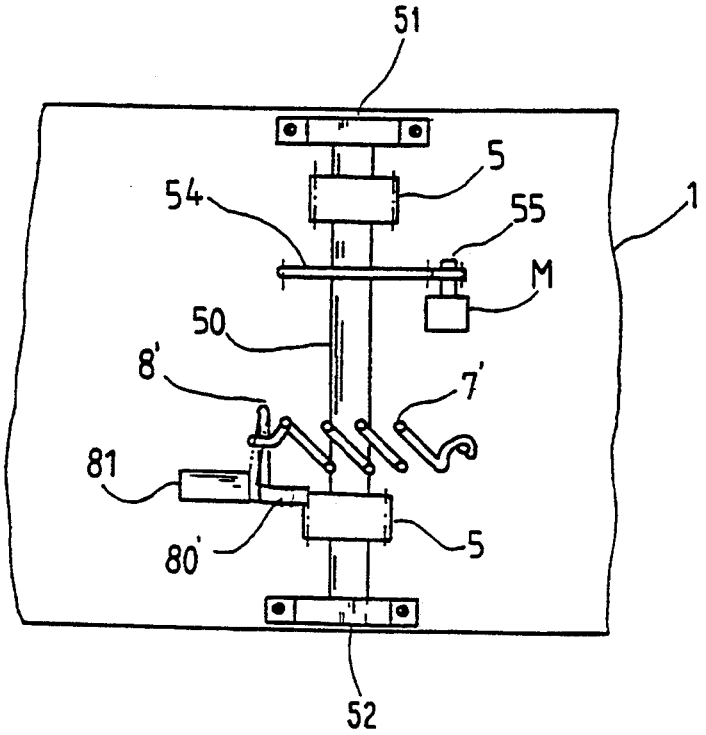
FIG. 5 is a partial top view of the alternate form of the height adjustment device of the present invention.
Figure 4:
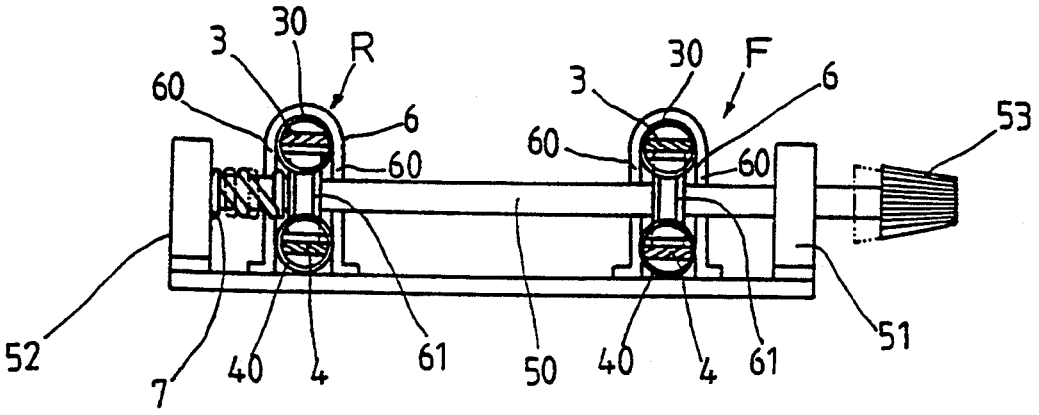
FIG. 4 is a side view of the height adjustment device.

Referring to FIG. 5, therein illustrated is an alternate form of the present invention. In this alternate form, a stop element 8′ is pivotably fastened to the base 1 adjacent to the rear driving gear 5 (the driving gear of the mechanism R spaced from the knob 53), having a locking projection 80′ releasably engaged into the teeth on the rear driving gear 5 to lock the mechanisms R, F A tension spring 7′ is fastened to the base 1 to render a pressure to the stop plate 8′, causing the locking projection 80′ of the stop plate 8′ to be constantly maintained in engagement with the teeth of the rear driving gear 5. An electromagnetic coil 81 is disposed behind the stop plate 8′. When the electromagnetic coil 81 is energized, the stop plate 8′ will be attracted by the magnetic force of the electromagnetic coil 81 such that the locking projection 80′ will be released frown the rear driving gear 5. The axle 50 is fastened with a big gear 54 meshed with a pinion 55 on the output shaft of a reversible motor M. The reversing switch (not shown) of the reversible motor M is electrically connected to the electromagnetic coil 81. As the reversible motor M is turned on, the electromagnetic coil 81 will be simultaneously energized. Therefore, the electromagnetic coil 81 is energized to draw the stop element 8′ rendering the locking projection 80′ of the stop element 8′ to be removed from the rear driving gear 5 as the reversible motor M is started to turn the axle 50 and the driving gears 5 in either direction. As the axle 50 is turned by the reversible motor M in either direction, the driving gears 5, 5 are turned to move the racks 3, 4 upwards or downwards, and therefore the height of the cover cushion 2 is varied. When the cover cushion 2 is varied to reach the desired elevation, the switch is switched off to stop the reversible motor M, and at the same time, the electromagnetic coil 81 is deenergized, and therefore, the locking projection 80′ of the stop plate 8′ is forced by the tension spring 7′ to engage into the teeth of the rear driving gear 5 again. Therefore, the cover cushion 2 is firmly maintained at the elevation after adjusted.

While preferred embodiments of the present invention have been shown and described with a degree of particularity with reference to the drawings, it should be understood that various modifications and changes could be made without departing from the spirit and scope of the invention.

What is claimed is:

1. A height adjustable pillow comprising a base, a cover cushion having a pillow face, said cover cushion supported on said base, and a height adjustment device mounted on said base for lifting said cover cushion, said height adjustment device comprising a front rack assembly, a rear rack assembly, and a driving mechanism, in which each one of said front and rear rack assemblies comprises a first rack, a second rack parallelly disposed below said first rack, locating frames bridged over said first and second racks, and guide tubes adapted to have the first and second racks slidably mounted therein and extended therethrough, said first and second racks being formed with teeth on opposing surfaces, said first and second racks each being attached to the bottom surface of said cover cushion opposite the pillow face, said guide tubes being curved upwards at an outer portion near the end of the racks attached to the cover cushion in order to guide and support the racks mounted and extended therethrough to curve upwards, said driving mechanism comprising an axle supported on spaced bearings, two spaced driving gears, adapted to be fitted to the axle, respectively meshed between the first and second racks of either rack assembly, and a knob mounted on one end of said axle for turning said axle and said driving gears, said locating frames constraining movement of said first and second racks to an axial direction, whereby turning said knob in either direction will cause the first and second racks of said front and rear rack assemblies to move the racks to lift said cover cushion, or downwards to lower said cover cushion.

2. The height adjustable pillow of claim 1, wherein said guide tubes are disposed at two opposite sides relative to said driving gear, are respectively secured by a support means between said guide tubes.

3. The height adjustable pillow of claim 1, wherein said height adjustment device further comprises lock means retained by spring means to lock said driving mechanism, said lock means being releasably removed from said driving mechanism as said knob is pushed inwards to slide said axle on said bearings.

4. The height adjustable pillow of claim 1, wherein said height adjustment device further comprises a reversible motor adapted to turn said axle in either direction, lock means retained by spring means to lock said driving mechanism, and an electromagnetic coil electrically connected to said reversible motor and energized to release said lock means from said driving mechanism as said reversible motor is turned on in either direction.

* * * * *